US008920215B2

(12) United States Patent
Redaelli

(10) Patent No.: US 8,920,215 B2
(45) Date of Patent: Dec. 30, 2014

(54) SURFACE FLOW FINISHING MACHINE

(71) Applicant: Paolo Redaelli, Biassono (IT)

(72) Inventor: Paolo Redaelli, Biassono (IT)

( * ) Notice: Subject to any disclaimer, the term of this patent is extended or adjusted under 35 U.S.C. 154(b) by 0 days.

(21) Appl. No.: 14/350,351

(22) PCT Filed: Nov. 21, 2012

(86) PCT No.: PCT/IB2012/002467

§ 371 (c)(1),
(2), (4) Date: Apr. 7, 2014

(87) PCT Pub. No.: WO2013/084037

PCT Pub. Date: Jun. 13, 2013

(65) Prior Publication Data

US 2014/0256235 A1 Sep. 11, 2014

(30) Foreign Application Priority Data

Dec. 6, 2011 (IT) ..... MI2011A2227

(51) Int. Cl.
*B24B 31/023* (2006.01)
*B24B 31/02* (2006.01)
*B24B 31/00* (2006.01)

(52) U.S. Cl.
CPC ..... *B24B 31/0212* (2013.01); *B24B 31/003* (2013.01); *B24B 31/0224* (2013.01)
USPC ..... 451/65; 451/66; 451/106; 451/113; 451/327; 451/328

(58) Field of Classification Search
CPC ..... B24B 1/003; B24B 31/06; B24B 31/064; B24B 31/073; B24B 31/0224; B24B 31/023
USPC ..... 451/65, 66, 104, 106, 113, 326, 327, 451/328
See application file for complete search history.

(56) References Cited

U.S. PATENT DOCUMENTS

| | | | | |
|---|---|---|---|---|
| 2,921,412 | A * | 1/1960 | Kay | 451/113 |
| 2,921,413 | A * | 1/1960 | Kay | 451/113 |
| 4,209,947 | A | 7/1980 | Ohno et al. | |
| 4,652,469 | A | 3/1987 | Hiller et al. | |
| 4,693,037 | A * | 9/1987 | McNeil | 451/34 |
| 6,210,258 | B1 * | 4/2001 | Malkin et al. | 451/74 |
| 6,688,953 | B2 * | 2/2004 | Kawasaki et al. | 451/327 |

(Continued)

FOREIGN PATENT DOCUMENTS

JP 58102670 6/1983

OTHER PUBLICATIONS

PCT International Search Report mailed on Dec. 21, 2012 for PCT Application PCT/IB2012/002467 filed on Nov. 21, 2012 in the name of Paolo Redaelli.

(Continued)

*Primary Examiner* — Timothy V Eley
(74) *Attorney, Agent, or Firm* — Steinfl & Bruno, LLP

(57) ABSTRACT

A machine for the flow finishing of mechanical pieces is described. The machine has a rotary vat for containing finishing media and a unit for moving pieces having at least one mechanical arm for moving the pieces being machined, said mechanical arm being associated to means for rotating the pieces within the rotary vat, the rotary vat has at least two separate sections formed by concentric circular crowns.

12 Claims, 7 Drawing Sheets

(56) References Cited

U.S. PATENT DOCUMENTS

| | | | | |
|---|---|---|---|---|
| 6,729,937 | B2 * | 5/2004 | Kawasaki | 451/10 |
| 6,960,116 | B2 * | 11/2005 | McNeil et al. | 451/36 |
| 2012/0064804 | A1 * | 3/2012 | Hammond et al. | 451/32 |

OTHER PUBLICATIONS

PCT Written Opinion mailed on Dec. 21, 2012 for PCT Application PCT/IB2012/002467 filed on Nov. 21, 2012 in the name of Paolo Redaelli.

* cited by examiner

SURFACE FLOW FINISHING MACHINE

CROSS REFERENCE TO RELATED APPLICATIONS

The present application is the US national stage of International Patent Application PCT/IB2012/002467 filed on Nov. 21, 2012 which, in turn, claims priority to Italian Patent Application MI2011A002227 filed on Dec. 6, 2011.

TECHNICAL FIELD

The present invention refers to a surface flow finishing machine.

BACKGROUND ART

The history of metal (and non-metal) surface mass finishing is based on various modes regarding the method through which the mass constituted by the media and the pieces is moved.

The first known mode in modern times (after the second world war) is that of the rotary tumbler, a cylindrical vat subjected to a rotary movement, within which the moving mass rolls, developing a typical "wave" movement on whose descending ramp there develops an interesting slide of the pieces, with extremely valid finishing levels, revealing the drawback of not being very fast.

This method is common up to date, for example, in some processes such as optical glasses finishing process.

In the 60's Dr. Manfred Dreher, from Pforzheim, Germany, started off with the first solution of the satellite tumbler though he abandoned the vertical solution after various experiments. The Dreher satellite tumblers, obtained using horizontal barrels, allow optimal finishing levels as well as very low process times.

This solution then spread all over the world and, currently, it represents one of the most common techniques in Asian countries. The movement within barrels is partly similar to that of the tumbler, but accelerated within the times and in the centrifuge forces developed therein. Furthermore, right from the 60s, the first series of uses with pieces mounted (thus fixed) on a framework is associated to this type of "mass finishing" technique, while a finishing "media" incoherent mass finishing rotates therearound.

From this primordial concept there are obtained perfect pieces, without dents (like it may occur should one leave them in a free mass) and having smooth and shiny surfaces.

Even today many finishings obtained using satellite tumblers cannot be equalled, in the quality/cost ratio of the finishing process, with other known systems.

However a first drawback of this technique lies in the capacity of the machines, which can have extremely large dimensions.

A second drawback lies in the difficulty of loading and unloading, barrel by barrel.

A third considerable drawback lies in the difficulty of forming multi-step cycles, for example with intermediate rinsing operations, given that each would require a manual intervention opening the barrels one by one, and so on and so forth, this being another reason why they are more common in Asia, for example, than in Europe.

The late sixties and the early seventies marked the introduction of the first machines constituted by vibrant vats both of the toroid or circular type and of the linear or rectangular type. This system replaces the rotary tumbler in many applications, due to the considerable flexibility of use, the greater automation, the lower water demand with respect to a tumbler in the wet type of process, the ideal operating mode for the wet and dry processing (extremely common processes), as well as for drying using plant grains.

The seventies and eighties marked the introduction of the first spindle finishing machines constituted by a rotary vat containing the finishing media and the pieces supported by rotary spindles fixed to robust inclinable mechanical arms for the loading and unloading operations. These techniques initially became extremely common in the United States of America and they still are up to date, with machines increasingly quicker, sophisticated and protected in terms of safety.

A drawback regarding the use of this type of technique regards the poor productivity; regardless of the speed and efficiency of the processes actually there can be loaded two pieces per cycle, by hand.

Around the early eighties there were introduced the first Japanese, American and European machines of the rotary disc centrifuge type (disc finishing). They offer advantages analogous to the vibration finishing solution but with quicker times as long as the processed pieces are not very large. The use limit thereof is the cost of the spare discs, which are extremely high in some cases.

Various applications arise, also in this solution, by holding the pieces fixed to some devices (for example a rotary shaft), exposing it to the flow of the media in quick rotation. The companies that applied this technique mainly included Polish and Italian companies that generally operate in the jewellery industry.

Probably still in the eighties the German constructor Walther Trowal introduced drag finishing machines, mostly used without vibrating, with very large vats and rotary heads with large rotary spindles where the pieces to be subjected to finishing are submerged.

Large distribution in the nautical industry (propellers for marine engines), in the medical industry, in the aerospace industry, boost this technology. Shortly later some constructors exploited the very same finishing principle providing machines with static vat. Each of these machines represent the state of the art and the frequency of application based on vibrating vats is very limited, if not entirely unused.

Early in 2011 the German company Otec Präzisionsfinish GmbH proposed a machine very similar, if not identical in the mode of the finishing media mass, arranged in a rotary vat, to that of the aforementioned spindle finishing. The machine is slightly different from the modern spindle finish (for example Almco Finishing and Cleaning Systems—USA) due to the criterion of positioning the spindles, which allows loading and unloading the pieces even while the machine is operating.

This system—also referred to as stream finishing—is quite complex from a mechanical point of view and it is based on an indexed head which supports rotary spindles. The head may perform a vertical excursion for prospecting the pieces supported by the rotary spindles to the finishing media mass rotating in the vat.

The rotary vat adopted in the known techniques, such as for example the spindle finishing, allows entry to one or more spindles in a mass constituted by the finishing media.

In the example in which an article should be subjected to two or more finishing media such as, for example a roughing media, a smoothening media and a polishing media, the machines operating according to the prior art, would require translating the spindle from one vat to the other or, alternatively, having only one machine with only one vat, replacing the roughing media with the smoothing ones, and subsequently, the smoothing one with the polishing ones.

SUMMARY

An object of the present invention is to overcome the aforementioned drawback, by providing a surface finishing machine which allows combining versatility of use, execution rapidity with costs and low dimensions.

Another object is that of attaining said result in a practical and inexpensive manner.

Said objects are attained due to a surface flow finishing machine comprising a rotary vat for containing finishing media and a unit for moving pieces comprising at least one mechanical arm for moving the pieces being machined, said mechanical arm being associated to means for rotating the pieces within the rotary vat, said rotary vat being characterised in that it comprises at least two separate sections formed by concentric circular crowns.

The invention has numerous advantages, for example including:

a) Cost of the machine—the machine would have a slightly varied cost with respect to a machine of the prior art, solely the strictly necessary to obtain channels, or separate sections, within the vat;

b) Space—the machine, for performing the task that in the prior art should be performed by two or three vats, maintains almost the same dimensions of a machine for a single step;

c) Versatility—the machine, due to the particular design of the multichannel vat, may mount a type of vat today and another one the following day, due to a gravity replacement, with coupling geometry. It is sufficient to arrange an overhead crane for lifting the vat from the seat thereof and, subsequently, fixing another one with different channels and/or with media loads of different formulation and/or composition;

d) Execution speed—the times of displacement of a spindle from one channel to the next one are much quicker in seconds than the passage from one large vat and another large vat, with the consequence that such operation, deemed hundreds of times per day, would lead to quite considerable total difference times;

e) Advanced technique—the peripheral speed of the most external channels is greater with respect to that of the intermediate channel and, also, with respect to the innermost one. This would allow an ideal distribution of the channels, where the outermost one could be preferably dedicated to the roughing action, the intermediate one to the polishing action and the innermost one to the fine polishing. Arranging media having an equivalent removal action but with large, medium and fine grain-size for large, medium and small articles, would allow meeting the expectations even in this case.

f) Multitasking operations—the daily productivity needs impose the provision of batches of large, intermediate and small articles and, in the case of the rotary multichannel vat there are no difficulties to simultaneously provide, though using different channels, processes with three (or more) spindles simultaneously;

g) Economy in the process costs—in the prior art it is necessary to displace three vats with, for example, 250 kg of load each. In order to develop such peripheral speed and such finishing, in the multichannel vats, it may be sufficient to limit the load up to ⅓, at times even more, with ensuing reduction of the media purchase, use and disposal costs.

Further characteristics of the invention are can be observed from the dependent claims.

BRIEF DESCRIPTION OF DRAWINGS

Further characteristics and advantages of the invention will be apparent from reading the following description provided by way of exemplifying and non-limiting example, with reference to the figures illustrated in the attached drawings, wherein.

DETAILED DESCRIPTION

Figure 1:
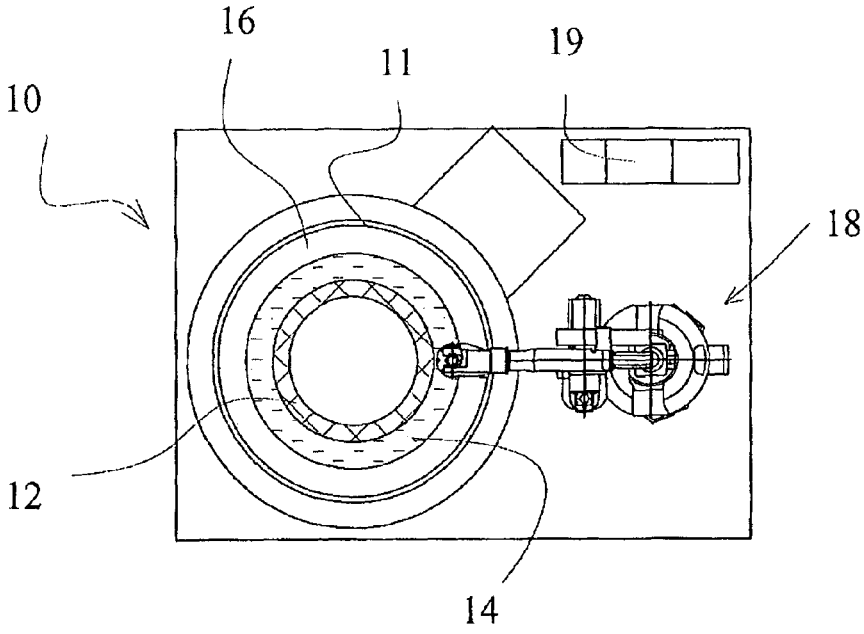
FIG. 1 is a top view of a first embodiment of the machine of the invention.

In particular, FIG. 1 shows a surface flow finishing machine according to the present invention, generally indicated with reference number 10. It comprises a rotary vat 11 for containing finishing media and a unit for moving pieces comprising at least one mechanical arm for moving the pieces being machined, which in the specific case is constituted by an anthropomorphic robot 18 adapted to pick pieces, whose surfaces should be machined by a bench 19, and rotate them within the rotary vat 11.

In particular, the rotary vat comprises three separate sections 12,14,16 formed by concentric circular crowns.

Preferably each of the separate sections 12,14,16 of the rotary vat 11 is adapted to receive a different finishing media.

Figure 2:
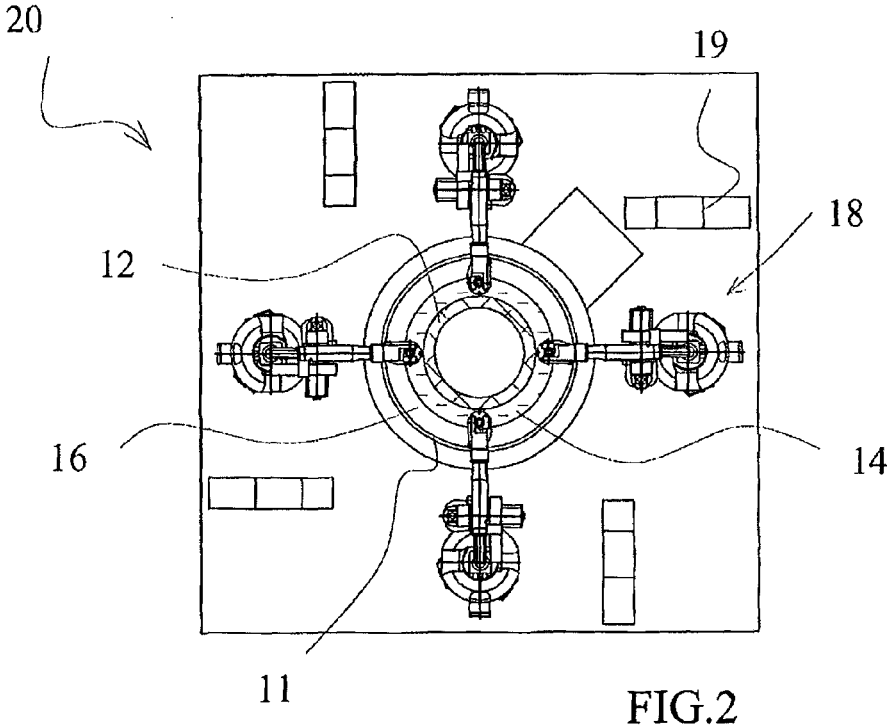
FIG. 2 is a top view of a second embodiment of the invention.

FIG. 2 shows—in top view—a second embodiment of the invention which differs from the embodiment of the figure due to the fact that it provides four anthropomorphic robots 18, each adapted to operate at a section of the rotary vat 11.

Each of the separate sections 12,14,16 of the rotary vat 11 is adapted to receive a different finishing media.

Thus this allows, within the same machine, performing for example a first machining with a first media in the outermost circular section 16, immediately after proceeding to a second machining with a second finishing media in the intermediate circular section 14 and lastly perform a third machining using a third finishing media in the innermost circular section 12.

The number of circular sections, as well as the filling thereof with different media may vary according to the machining needs.

Figure 3:
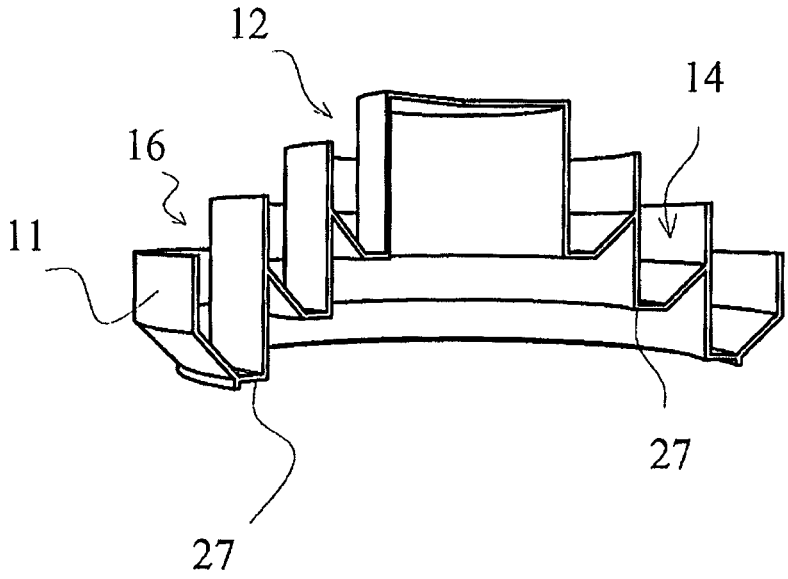
FIGS. 3 and 4 are exploded views of possible embodiments of a vat for a machine according to the present invention.
Figure 4:
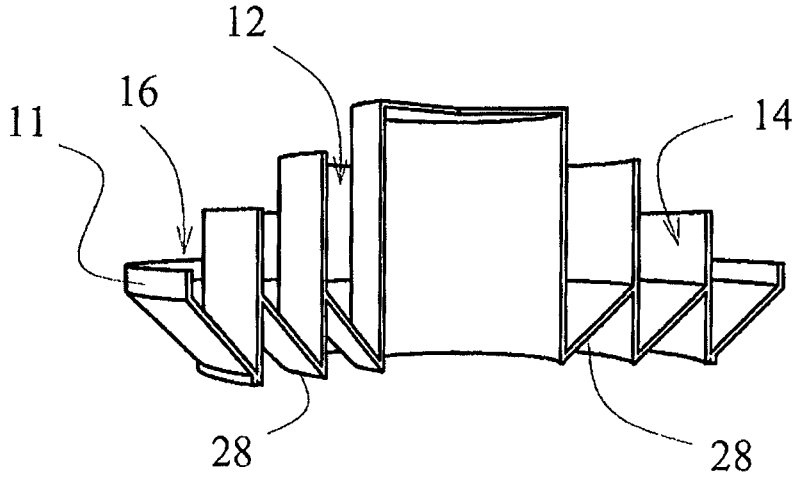

With reference to FIGS. 3 and 4, as regards the geometries and the portions of the rotary vat 11 according to the present invention, it should be observed that it has cylindrical sides and flat bottom, or hexagonal, octagonal or, however, polygonal sides and flat bottom.

However, studies aimed at providing improvements in relatively new applications, lead to studying innovative geometric shapes and sections for rotary vats, as follows:

a) Rotary vat with low steps having a trapezoid-shaped bottom 27 (FIG. 3).

b) Rotary vat with deep steps having a triangular-shaped bottom 28 (FIG. 4).

Figure 5:
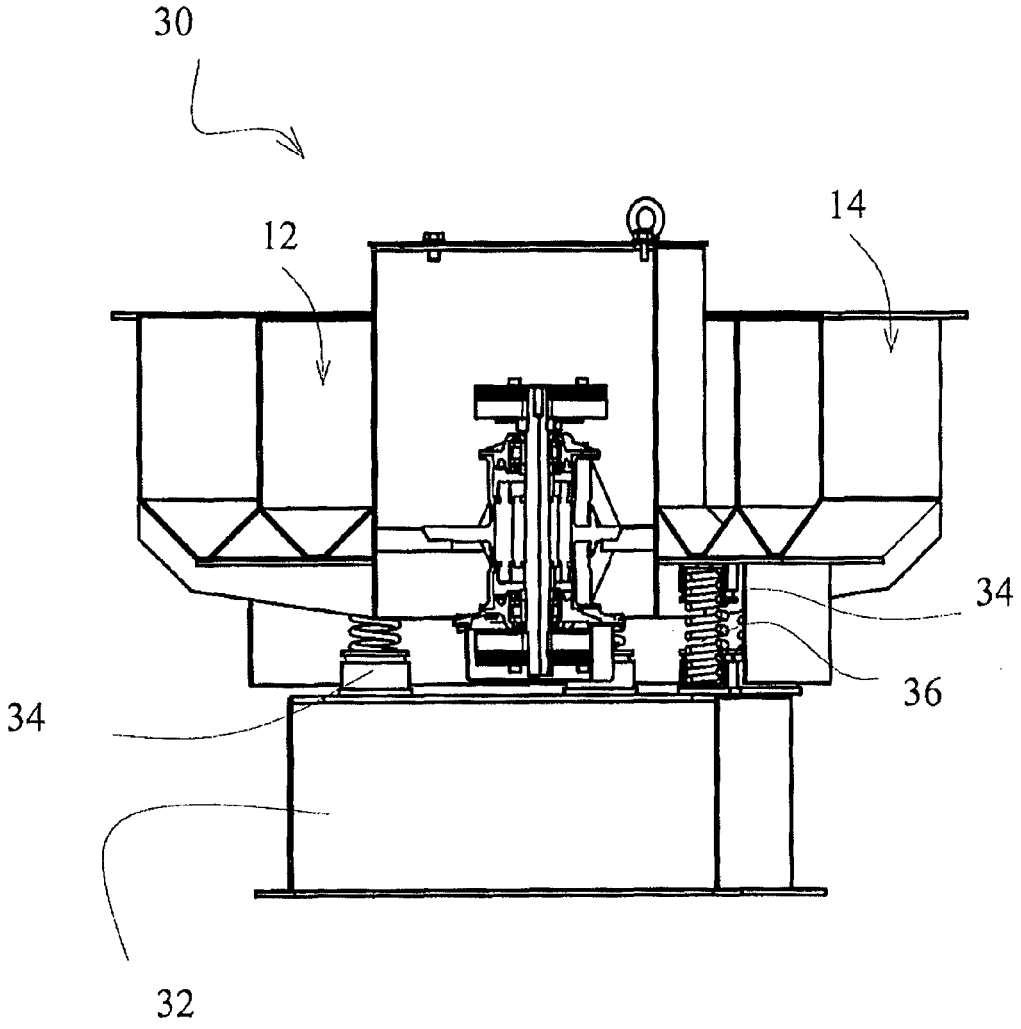
FIG. 5 is a sectional view of another embodiment of the invention.

Generally, each of the separate sections 12,14,16 of the rotary vat 11 may have a triangular, or trapezoid, or flat, or concave, or convex, or conical-shaped, or embossed or notched section bottom.

c) Vibrating rotary vat 30, with media mixing effect (FIG. 5).

FIG. 5 sectionally represents the machine 30 provided with a vibrating rotary vat, where only two separate sections 12, 14 are shown for the sake of simplicity.

The machine 30 has a base 32 supporting means 34 for subjecting the aforementioned rotary vat to vibration which may oscillate with the help of a series of springs 36 placed between the vat and the base, in special housings.

Figure 6:
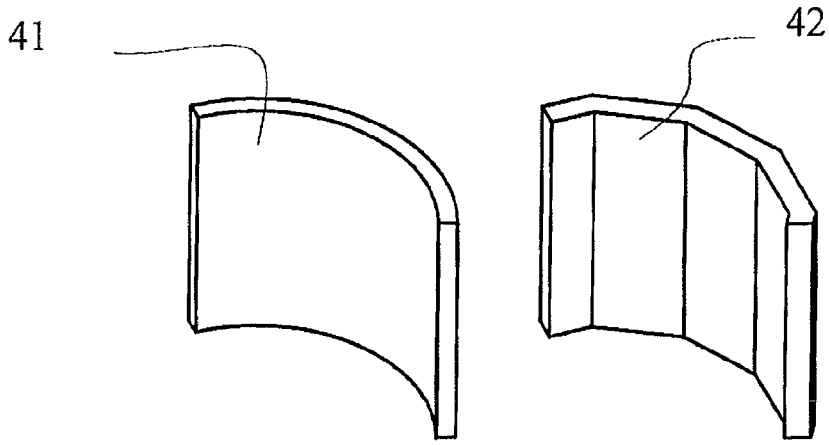
FIGS. 6 and 7 are exploded views of possible embodiments of internal portions of the vat for the machine of the invention.
Figure 7:
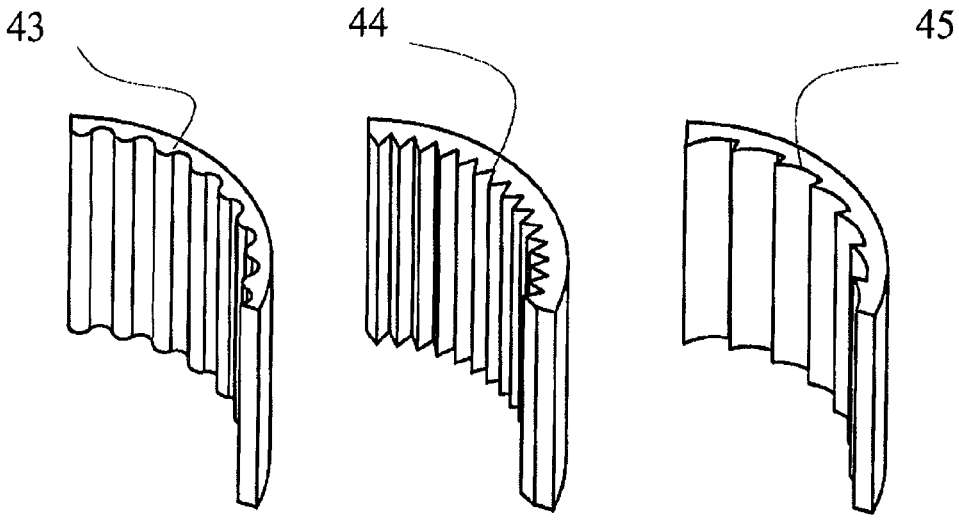

Besides the aforementioned geometries or combined compositions of these solutions, the walls of the separate sections of the vat, or channels, forming concentric circular crowns may be variably configured, i.e.:

d) External and/or internal polygonal 42 or circular 41 profiles (FIG. 6).

e) External and/or internal circular profiles with applied coverings made of polymeric or elastomeric material, or configured to form waves 43, notches 44 (gear type) or racks 45.

Figure 8:
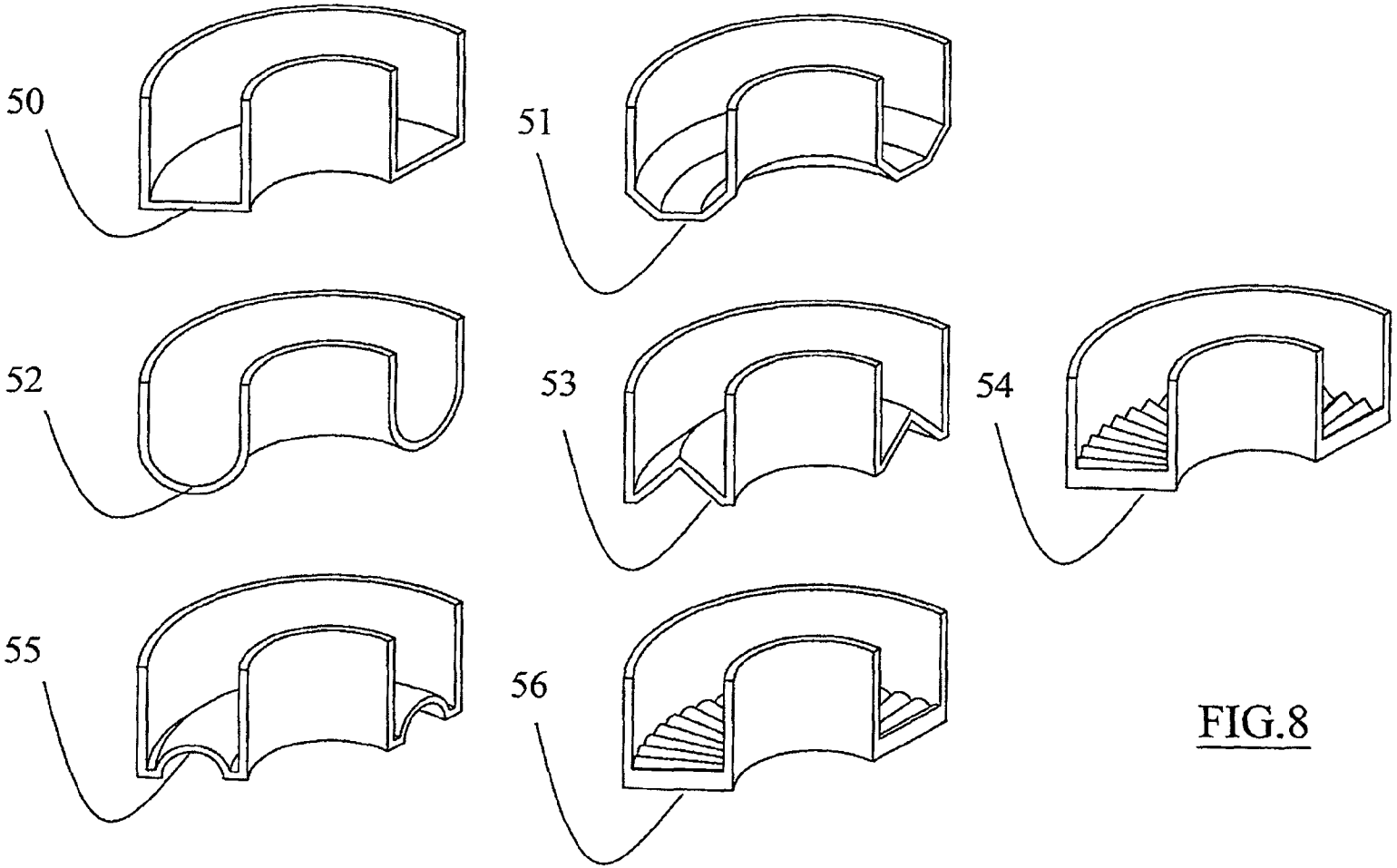
FIG. 8 shows exploded views of possible embodiments of the bottom of the vat for the machine of the invention.

As regards the further possibility for the bottom of the various separate sections of the vat (FIG. 8), it is possible to provide vat bottom having a flat 50, concave 52, convex 55, trapezoid 51, conical 53 shape, with hops 56 or notched 54.

When conducting tests aimed at comparing conventional and new methods, there was evaluated the use of more or less soft materials or preferably elastic or even resilient materials. In the context of a rotary vat, to which a piece to be machined is exposed, the hypothesis of more or less soft materials or, preferably, elastic, or even resilient materials may allow the use of the rotary vat in a manner similar to an abrasive spring or a cleaning cotton disc, depending on the type of the media introduced thereinto, the speeds and/or the aforementioned covering material, parallel to the particularly configured geometric shape thereof.

Furthermore, in order to make efficient some types of finishings it is useful to provide an ascent and descent movement of the vat according to predetermined frequencies, which can be considered an option which enriches the number of axes of the anthropomorphic robot.

Simultaneously it is useful and interesting to be able to provide a positioning of the vat in inclined position, such as bell tumbler vat (within given limits), for so as to be able to exploit a particularly favourable entry angle for some types of pieces.

In order to make some types of finishings efficient it is useful to exploit the eccentric (offset) movement of the finishing vat; this particular movement may be considered an extra variable among the various possible functions of the flow finishing machines (wave finishing).

Preferably there is provided a robotized handling of the pieces being machined (FIGS. 1 and 2).

In the prior art, for example in the spindle finishing the pieces to be processed are introduced and removed by the spindle of the machine. This operation could be automated using a manipulator and/or using an anthropomorphic robot 18 but requiring extra costs and space with respect to the finishing machine.

Also in the abrasive flow finishing machines (stream finishing) while two spindles operate, one can be connected in the loading and unloading functions, but the connection remains an extra function with respect to the finishing machine.

In the case of the new flow finishing machines (wave finishing), the design choice directly provides for the use of an anthropomorphic robot 18 with 6 or more axes, to perform the entire operation, from picking up the piece, to finishing and repositioning the piece. Optimal results can be obtained by providing the wrist of the robot with further drive means, so as to be able to rotate the spindle at will without using the accuracy of the axes of the robot, but an "additional axis" determined by the rotation motor. This concept of the machine is efficient and competitive.

The potentialities of the robot, as they currently are, do not allow the immediate optimisation of the finishing functions. Thus, there were studied targeted strategies for simultaneously attaining a competitive and more developed and powerful robot with respect to the market standards.

First and foremost, in order to attain optimal results the wrist of the robot was provided with further drive means, so as to be able to rotate the spindle, for example a Schunk gripper, at will without using the accuracy of the axes of the robot, but having a sort of "additional axis" determined by the drive motor. There is provided the use of compressed air, for example for maintaining the self-lubricating tips (in the hard metal tools industry) always clean in the internal gaps, limiting the risks of entrapment of media fragments or dust, is optimised through particular coupling interfaces of the rear end (for anchoring) of the piece to the insufflation point. The insufflation interface is in turn characterised by a damper-equipped part, a universal side for coupling to the gripper and the other personalised with respect to the diameter and/or the geometry of the piece to be maintained insufflated during the machining; this insufflation technique, with reference to the finishing, represents an innovation and an improvement aimed at achieving constant quality and without the problems related to clogging, micro occlusions, or any other problems.

In the prior art, such as for example in the spindle finish or even in the abrasive flow finishing (Stream Finishing), the pieces to be machined are mounted in the spindle, one per spindle.

In the machines according to the present invention instead, there was studied a wrist capable of supporting a plate with two, three, four or more motors that support an equal number of spindles, such as for example Schunk grippers, so as to be able to simultaneously machine several pieces per cycle.

As regards the final cleaning of the machined pieces, each time the pieces exit from a dry finishing cycle, the robot can introduce them in a special suitably positioned cylinder, so that the same pieces can be energetically involved by a jet of compressed air for over the required period of time, rotating them if needed, while the residual media and/or the residual dust on the piece can be removed and directed, by dropping, to the machining vat or to a recovery container.

Every time the pieces exit from a wet finishing cycle, the robot can introduce them into a special suitably positioned cylinder, so that the same pieces can be energetically involved initially by a high pressure water jet, then by a compressed air jet over the required period of time, rotating them if needed, while the residue is directed, by dropping, to the machining vat.

The accessory media suction and automating reloading system provides an alternative to the replacement of the vat with another one.

Particularly suitable for dry processes, this function is required and useful for optimizing and/or automating all the steps of periodic media replacement.

The operating principle is based on the use of dust suction and reduction systems, preferably certified by Atex (z. 21) and/or by media storage silos, with discharge valve.

There are several possible versions, some semi-automatic, others automatic, with 2 or several levels of manageable media.

In the automatic versions there is provided an oil-hydraulic platform for lifting the rotary vat, so as to reach the suction and/or reloading points automatically.

Also this type of solution is innovative and unprecedented in the finishing machines industry.

What has been defined above regarding machines of the invention can be applied, after simple modifications, also to machines for machining with the concept regarding drag finishing suitably modified.

Figure 9:
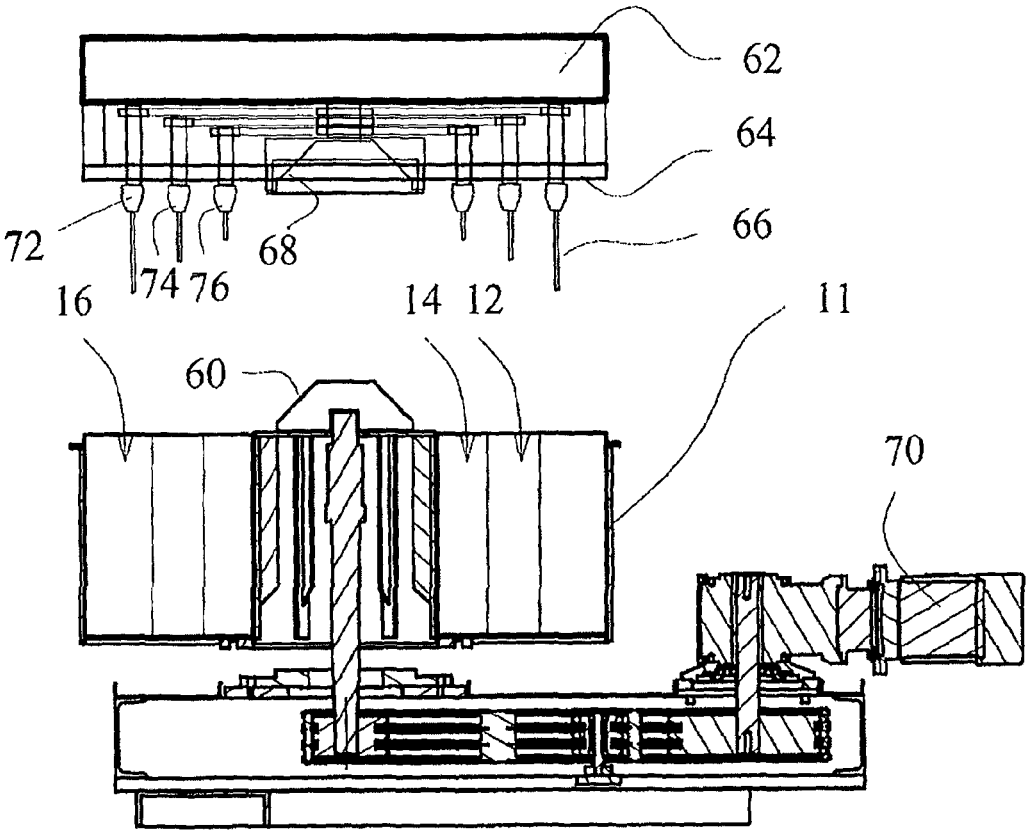
FIGS. 9 and 10 are sectional views of a further machine of the invention in two different positions.
Figure 10:
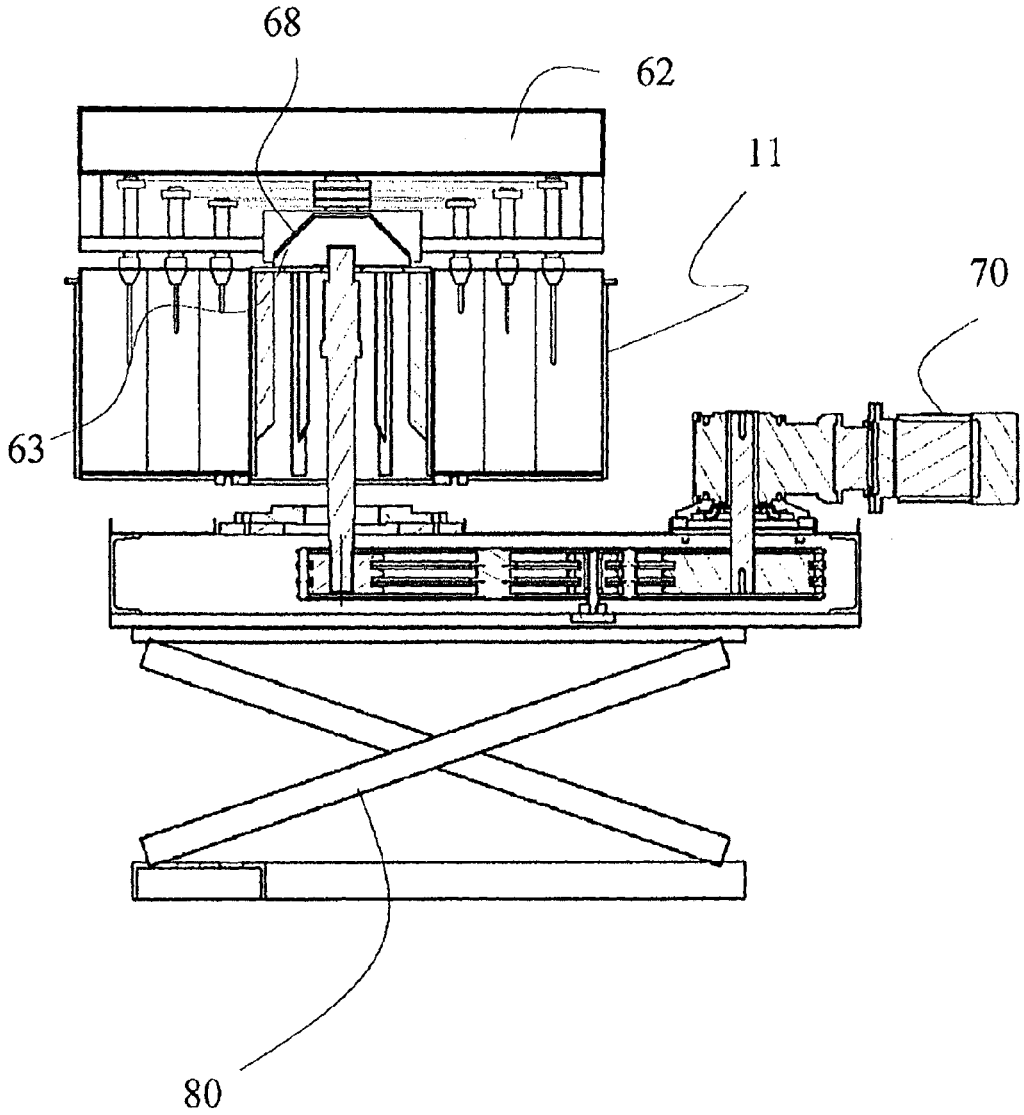

In this case, represented in FIGS. 9 and 10, over the rotary vat there is arranged a simple indexed rotary head 62, to which there is fixed an additional plate 64 complete with the mechanisms required for coupling to the underlying vat, which can be driven by a motor 70 coupled to the relative mechanisms.

Considering a head index at 25°, during the loading step the robot 18 performs the loadings at each angle, first fixing the connectors with the pieces corresponding to the internal corolla 76, then those of the central corolla 74 and lastly those of the external corolla 72.

The loading mode, using the robot, on a concentric three-corolla-head, thus considers four sets of equally-spaced spindles:

a) 360° angle—respectively fixing the internal connector, corolla 76, then the median connector, corolla 74, lastly the external connector, corolla 72;

b) 90° angle—the robot repeats the same operations like above;

c) 180° angle—the robot repeats the same operations like above;

d) 270° angle—the robot repeats the same operations like above;

The unloading operations would occur in an analogous but inverse manner. Subsequently the multichannel rotary vat rises towards the indexed head 62, for example by activating an oil-hydraulic platform 80.

During this step the central part of the rotary vat, provided with a special coupling cone 60 made of metal with covering or components made of polymeric and/or elastomeric material, enters at the centre of the additional plate 64, where there is a conical coupling seat 68, mounted on the indexed head 62 and transmits the rotary movement of the vat to the mechanism which rotates the rotary spindles (where there are fixed the connectors), allowing the exposure of the pieces during the process on several sides at 360°.

Lastly, it should be observed that the choice of the hardware to be combined to the flow finishing processes (Wave Finishing), should be mainly made in according to the following concept (indicative and non-exhaustive example):

| Piece finishing needs | Number of pieces to be processed | Loading and unloading | Machine choice |
|---|---|---|---|
| Times below 5' min. | 200-250/day, small medium dimensions | simple with robot | Machine FIG. 1 |
| Times below 5' min. | 800-1000/day, small medium dimensions | Simple with several robots | Machine FIG. 2 |
| Times above 15'-20' min | 30-100/day, large dimensions | Simple with several robots | Machine FIG. 2 |
| Times above 15'-20' min | 300-500/day, small medium dimensions | Pieces with connector or framework | Machine FIG. 9-10 |

-continued

| Piece finishing needs | Number of pieces to be processed | Loading and unloading | Machine choice |
|---|---|---|---|
| Times above 35'-60' min. | 30-100/day, large dimensions | Pieces with connector or framework | Machine FIG. 9-10 |

Obviously, the invention subject of the description may be subjected to numerous practical-applicational modifications, without departing from the invention idea as claimed below.

The invention claimed is:

1. A surface flow finishing machine comprising:

a rotary vat for containing finishing media, and a unit for moving pieces, the unit comprising at least one mechanical arm for moving the pieces, said mechanical arm being provided with means for rotating the pieces within the rotary vat, wherein said rotary vat comprises at least two separate sections for containing media formed by concentric circular crowns.

2. The machine according to claim 1, wherein each of the separate sections of the rotary vat is adapted to receive a different finishing media.

3. The machine according to claim 1, wherein each of the separate sections of the rotary vat has a triangular, inclined or partly inclined, flat, concave, convex, conical shaped, embossed or notched section bottom.

4. The machine according to claim 1, further comprising means for subjecting the rotary vat to vibration.

5. The machine according to claim 1, wherein external and/or internal surfaces of each of the separate sections formed by concentric circular crowns of the rotary vat are polygonal-shaped.

6. The machine according to claim 1, wherein external and/or internal surfaces of each of the separate sections formed by concentric circular crowns of the rotary vat are wave, notch or rack-configured.

7. The machine according to claim 1, wherein the mechanical arm comprises an anthropomorphic robot.

8. The machine according to claim 7, wherein the anthropomorphic robot comprises one or more piece-holder grippers provided with rotary movement.

9. The machine according to claim 1, further comprising an oil-hydraulic platform to rise the vat.

10. The machine according to claim 1, wherein the vat is arranged in an inclined position.

11. The machine according to claim 1, further comprising means for conferring an eccentric or offset movement of the finishing rotary vat.

12. The machine according to claim 1, further comprising a head provided with a plurality of rotary spindles which can be actuated in rotation by a mechanism associated thereto and with a conical coupling seat mounted thereon, a unit for lifting the rotary vat, the rotary vat being equipped with a coupling cone, the lifting unit being adapted to place the rotary vat in a position such that the pieces are submerged in the separate sections of the vat and the coupling cone transmits the rotation of the rotary vat to the rotation mechanism of the spindles by entering into the conical coupling seat.

* * * * *